US005459877A

United States Patent [19]

Roberti

[11] Patent Number: 5,459,877

[45] Date of Patent: Oct. 24, 1995

[54] BURPERETTE

[76] Inventor: Theresa Roberti, 39 Golf Club Cir., Manorville, N.Y. 11949

[21] Appl. No.: 912,701

[22] Filed: Oct. 13, 1992

[51] Int. Cl.[6] ..... A41B 13/10; A41D 1/20

[52] U.S. Cl. ..... 2/104; 2/46; 2/49.2; 2/49.1; 2/247

[58] Field of Search ..... 2/46, 48, 49.1, 2/49.2, 49.3, 49.4, 495, 52, 50, 51, 75, 80, 83, 104, 88, 89, 105, 106, 114, 247

[56] References Cited

U.S. PATENT DOCUMENTS

| | | | |
|---|---|---|---|
| 1,701,152 | 2/1929 | Freedman | 2/48 |
| 2,482,182 | 9/1949 | Henniger | 2/48 |
| 2,563,420 | 8/1951 | Roe | 2/48 |
| 2,640,197 | 6/1953 | Murray | 2/48 |
| 2,674,739 | 4/1954 | Barnett | 2/50 |
| 2,722,685 | 11/1955 | Lucas | 2/48 |
| 2,857,599 | 10/1958 | Wallace | 2/48 |
| 2,955,293 | 10/1960 | Peterson | 2/48 |
| 3,945,048 | 3/1976 | Shearer | 2/48 |
| 4,689,830 | 9/1987 | Williams | 2/50 |

*Primary Examiner*—Jeanette E. Chapman
*Attorney, Agent, or Firm*—William F. Andes, Jr.

[57] ABSTRACT

A multi-purpose bib comprised of material and being generally in rectangular form having first and second long edges, first and second short edges, and a first surface and a second surface. One of the long edges of the bib has a neck cut-out portion. An elongated fastener is secured on the first surface, disposed horizontally to a long edge, and located near the corner formed by the intersection of the first long edge and the first short edge. Another elongated fastener is secured to the second surface, disposed horizontally to a long edge, and located near the corner formed by intersection of the second long edge and the first short edge. The two elongated fasteners are releasably securable to each other by hook and loop fasteners and when secured to each other form a cup portion. The material may be water resistant and washable, and there is a means for securing the neck cut-out portion to the neck of an adult or infant. The long and short edges may have decorative eyelet trim for aesthetic purposes.

11 Claims, 4 Drawing Sheets

BURPERETTE

BACKGROUND OF THE INVENTION

The present invention relates to a bib-like device for use by a parent when caring for an infant and includes a generally rectangular piece of material, first and second long edges, first and second short edges, first and second surfaces, a neck cut-out portion, and first and second elongated fasteners.

Infants frequently burp or regurgitate when being held by an adult. Devices designed to prevent the soiling of clothes when an infant is held by an adult are well known in the art. These devices essentially consist of a cloth, dishrag or cloth diaper being placed over an adult's shoulder while holding the infant over that same shoulder. One basic function of these devices is to prevent soiling of the adult's clothes and skin when an infant regurgitates or burps.

Notwithstanding their common uses, these bib-like devices have limitations. Often, the contents of the infant's mouth will not be entirely retained by the dish rag or diaper, thus soiling nearby clothes.

The present invention goes a long way toward solving the problems associated with caring for infants. A need exists to provide an easier and more convenient way to avoid the soiling of clothes.

Accordingly, it is an object of the invention to provide a multi-purpose bib which prevents an infant from soiling an adult's clothing.

Another object of the invention is to provide a flat convenient sanitary surface on which to change an infant's diaper.

A further object of the invention is to provide a multi-purpose bib which is easily washable, water resistant and aesthetic pleasing.

SUMMARY OF THE INVENTION

It has now been found that the objects of the present invention are obtained in a multipurpose bib consisting of a piece of material in generally rectangular form. The piece of rectangular material has first and second long edges, first and second short edges, a first surface and a second surface.

Along the first long edge is a neck cut-out portion of generally semicircular shape. An elongated fastener is secured on the first surface, disposed horizontally with regard to one of the long edges of the multipurpose bib, and located near to a corner formed by the intersection of said first long edge and said first short edge.

There is a second elongated fastener secured on the second surface. The second fastener is disposed horizontally with regard to one of the long edges of the multipurpose bib, and is located near the corner formed by the intersection of said second long edge and said first short edge.

The first and second elongated fasteners are releasably securable to each other. A cup portion is created when the first elongated fastener and the second elongated fastener are secured together.

In a different embodiment of the invention, the placement of the two elongated fasteners of the material of the multi-purpose bib is reversed. That is to say, the first elongated fastener is placed on the first surface but instead is located near the corner formed by the intersection of the second long edge and the first short edge. Furthermore, the second elongated fastener is placed on the second surface but instead located near the corner formed by the intersection of the first long edge and the first short edge.

The fabric of this multipurpose bib may be water resistant and washable. Furthermore, the first elongated fastener and the second elongated fastener may be made of hook and loop fasteners. The neck cut-out portion may have a means for securing the Multipurpose Bib around the neck of the adult or infant. The inventor has also found that the addition of eyelet trim adds to the aesthetically pleasing appearance of the invention.

The Multipurpose Bib easily forms a cup portion and is conveniently draped over the mother's shoulder by placing the neck cut-out portion around the mother's neck. When the infant is held with its mouth in the vicinity of the adult's or mother's shoulder, any contents expelled from the infant's mouth will be collected in the cup portion.

Used another way, the neck cut-out portion of the Multipurpose Bib may be placed around the neck of an infant and the front surface laid in front of the infant while the infant is being fed.

Used yet another way, the Multipurpose Bib can be laid flat on a surface, thereby providing a sanitary surface on which to change an infant's diaper. Furthermore, the Multipurpose bib can be folded neatly and compactly, making storage more convenient.

BRIEF DESCRIPTION OF THE DRAWINGS

The above brief description, as well as further objects and features of the present invention, will be more fully understood by reference to the following detailed description of the presently preferred, albeit illustrative, embodiments of the present invention when taken in conjunction with the accompanying drawings, wherein.

DETAILED DESCRIPTION OF THE PREFERRED EMBODIMENTS

Figure 1:
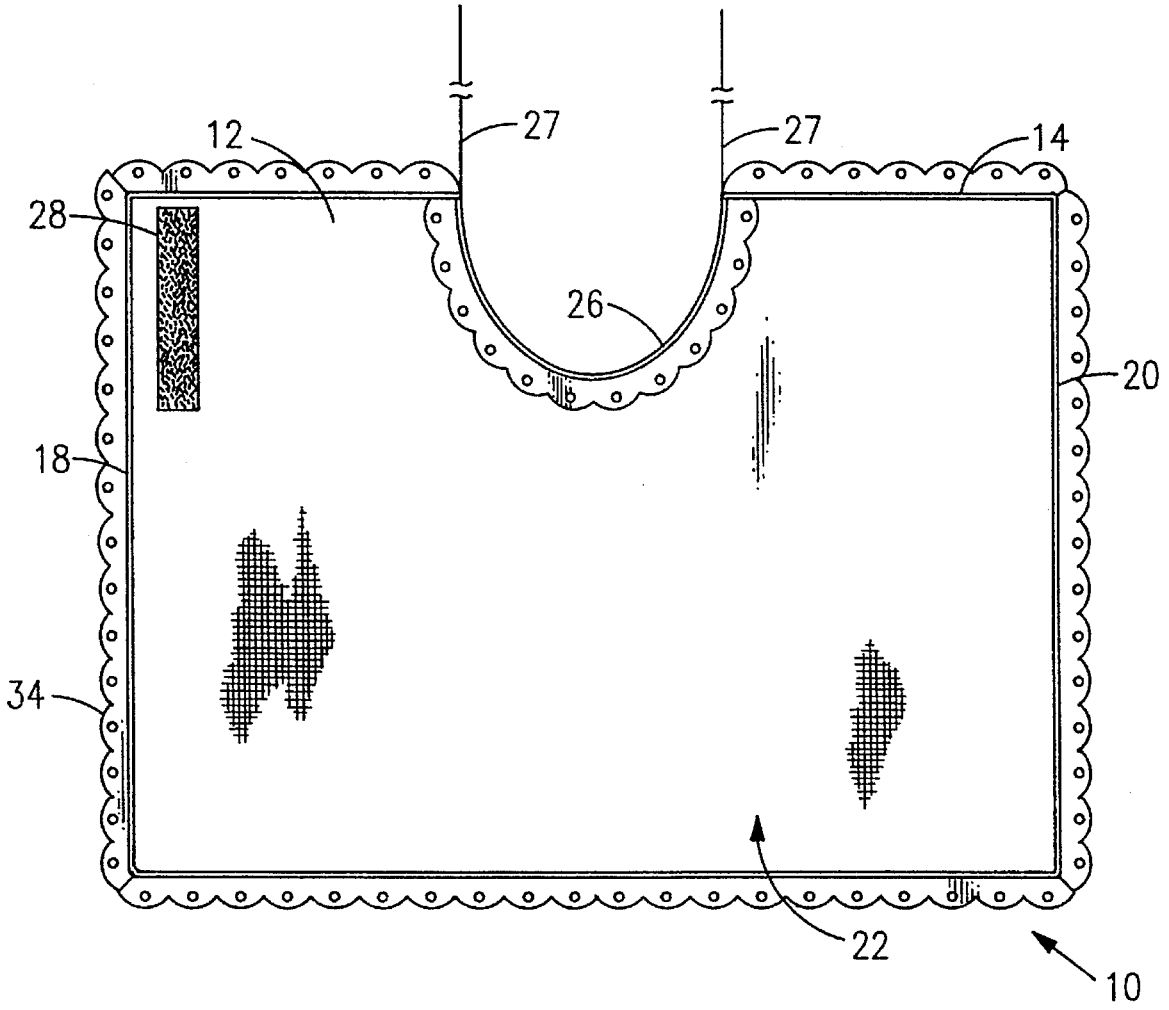
FIG. 1 is a top plan view.
Figure 2:
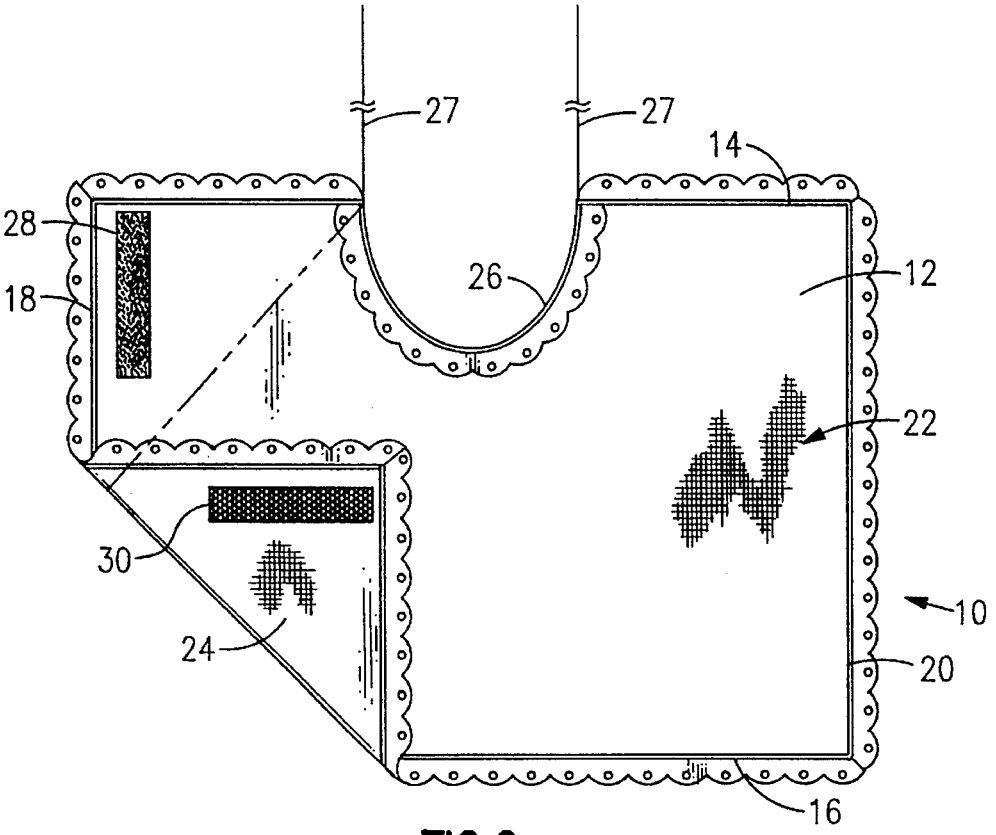
FIG. 2 is a plan view showing the forming of the cup portion.
Figure 3:
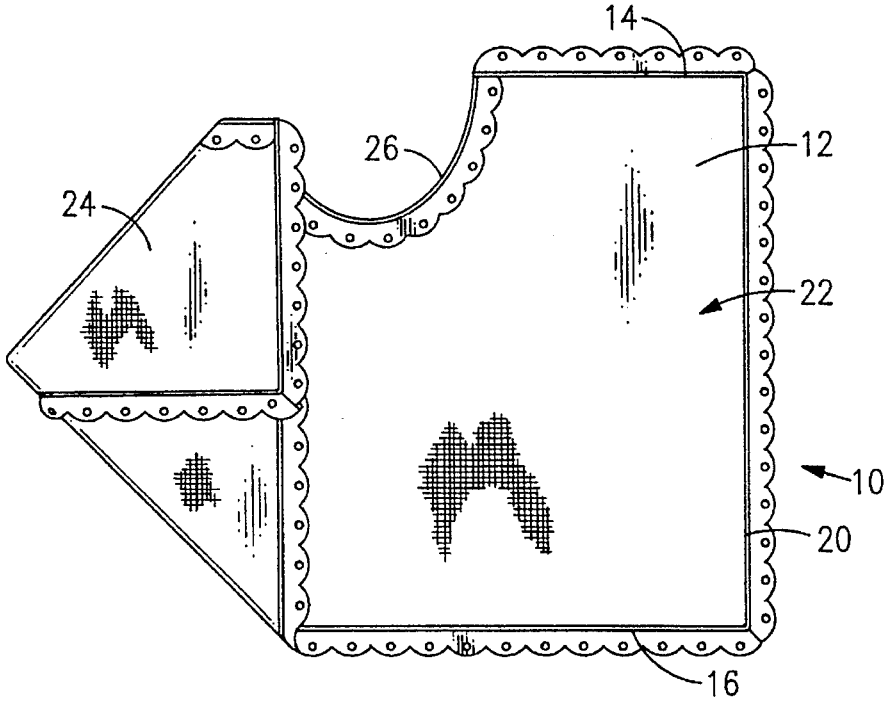
FIG. 3 is a plan view showing the cup portion.

Referring now to the drawings, and in particular to FIGS. 1, 2, 3, 4 and 5, therein illustrated is a Multipurpose Bib according to the present invention, generally designated by the numeral 10. As shown in FIGS. 1, 2 and 3, the bib includes a piece of material 12 in generally rectangular form having a first long edge 14 and a second long edge 16, a first short edge 18 and a second short edge 20.

The fabric also has a first surface 22 and a second surface 24. FIG. 1 shows the first surface 22 in its entirety and FIGS. 2 and 3 show the second surface 24 partially exposed.

A neck cut-out portion 26 exists on first edge 14, as shown in FIGS. 1, 2, 3, 4 and 5. The inventor has found that the neck cut-out portion 26 should be generally of semicircular shape, being configured and dimensioned to fit around an adult's neck. As shown in FIGS. 1 and 2, during use strings 27 may be used as a means for securing the Multipurpose Bib 10 to the neck of the adult or infant. Other well known means for securing include, by way of example and not by way of limitation, snaps and hook and loop fasteners.

A first elongated fastener 28, shown in FIGS. 1 and 2, is secured on first surface 22 and is disposed horizontally with respect to one of the bibs long edges 14 or 16. The first elongated fastener 28 is located near the first corner formed by the intersection of first long edge 14 and first short edge 18.

Shown in FIG. 2 is a second elongated fastener 30, secured to second surface 24 and releasably securable to the first elongated fastener 28. The second elongated fastener 30 is also disposed horizontally with respect to one of the bib's long edges 14 or 16 length and is located near the second corner formed by the intersection of long edge 16 and short edge 18.

Figure 4:
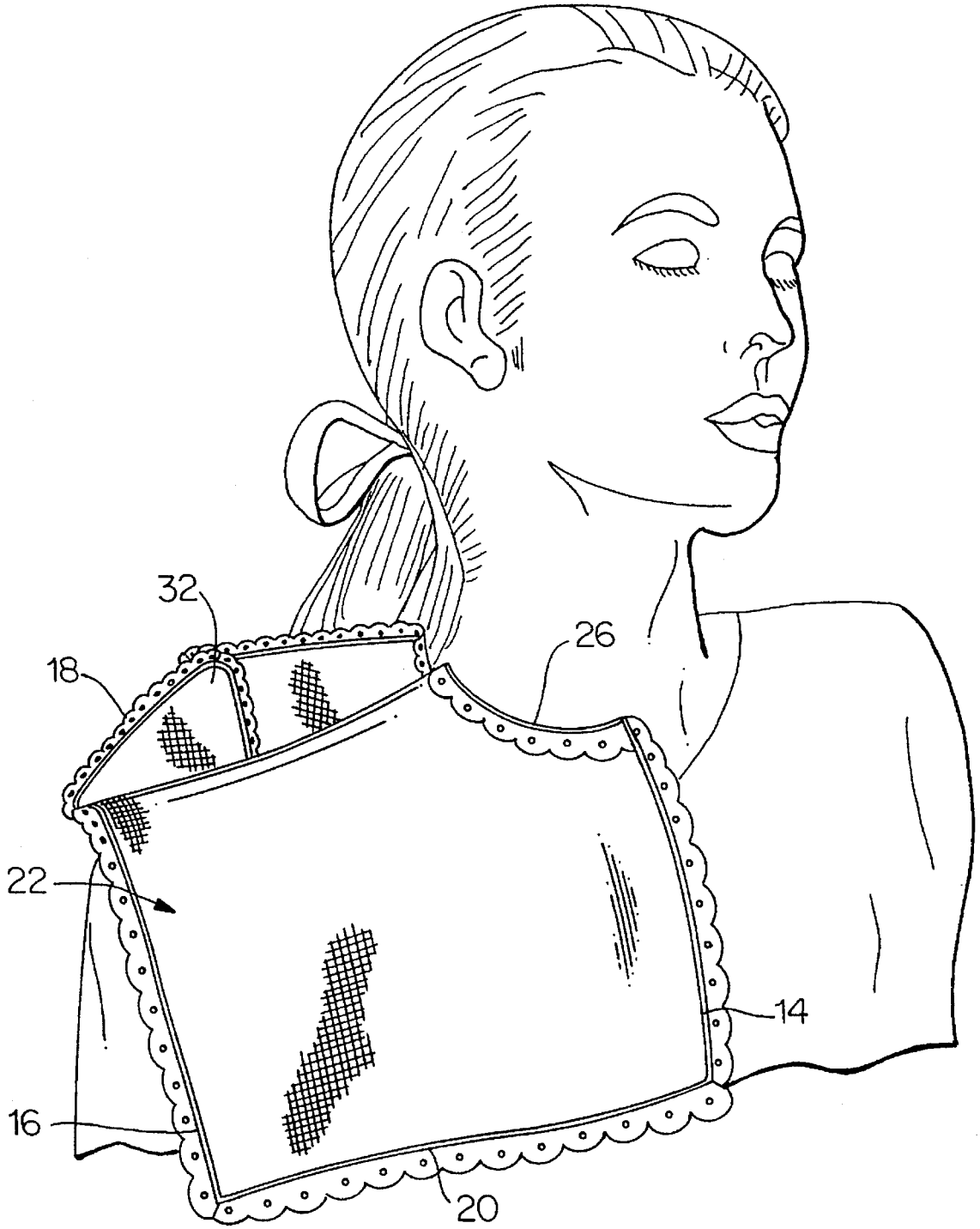
FIG. 4 is a front perspective view.
Figure 5:
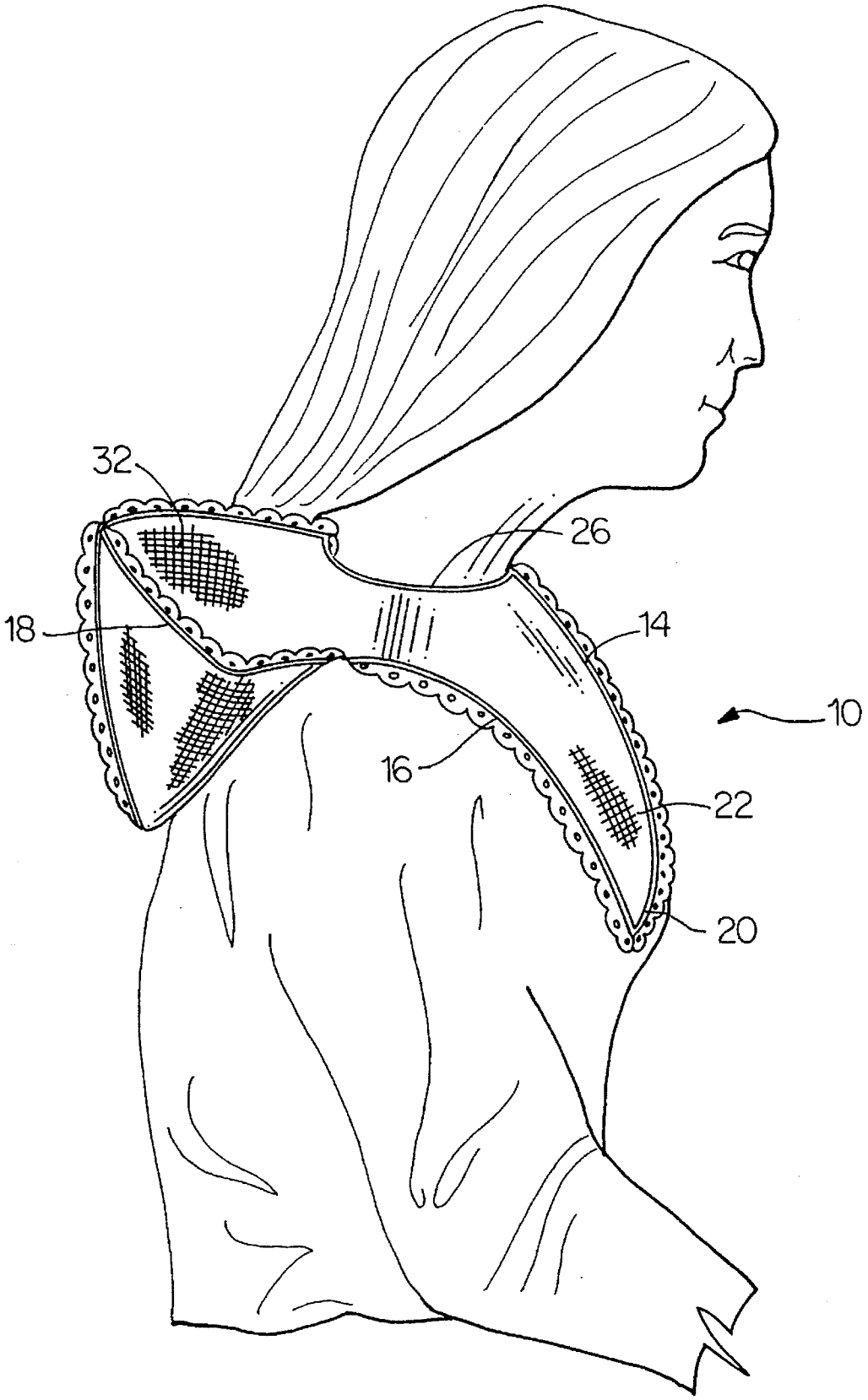
FIG. 5 is a side perspective view.

When the material 12 is folded such that the first elongated fastener 28 and the second elongated fastener 30 are releasably secured together, a cup portion 32 is formed by the securing of the first and second corners, as best shown in FIGS. 3, 4 and 5. In use, the cup portion 32 functions to collect the contents of an infant's mouth when burping or regurgitating or while being fed.

Preferably, the first and second elongated fasteners, 28 and 30, are hook and loop fasteners, sold under the trademark of VELCRO. The piece of fabric 12 is preferably water resistant and washable. The inventor has found that plastic covered with a soft cotton material works well, but recyclable or disposable material may be used as well. The inventor has also found that the addition of eyelet trim 34, as shown in FIGS. 1, 2, 3, 4 and 5, adds a more aesthetically pleasing appearance.

In an alternative embodiment of the invention, the placement of the first elongated fastener 28 and the second elongated fastener 30 are reversed. That is to say, the first elongated fastener 28 is placed on the first surface 22 but located near the first corner formed by the intersection of the second long edge 16 and the first short edge 18. Furthermore, the second elongated fastener 30 is placed on the second surface 24 but located near the second corner formed by the intersection of the first long edge 14 and the first short edge 18.

As described above and illustrated in the accompanying drawings, the Multipurpose Bib 10 of the present invention prevents an infant from soiling an adult's clothing and skin while being held by an adult, and prevents the soiling of an infant's clothing while being worn by the infant. The Multipurpose Bib 10 is washable, water resistant and aesthetically pleasing. The Multipurpose Bib 10 is easily laid flat, folded and stored conveniently and easily. Finally, a flat, convenient sanitary surface on which to change an infant's diaper is provided.

Now that the preferred embodiments of the present invention have been shown and described in detail, various modifications and improvements thereon will become readily apparent to those skilled in the art. Accordingly, the appended claims should be construed broadly and in a manner consistent with the spirit and scope of the invention herein, and not limited by the foregoing specification.

I claim:

1. A multipurpose bib comprising:

A. a piece of material being in generally rectangular form, having a first and a second long edge, a first and a second short edge, a first surface and a second surface;

B. a neck cut-out portion on said first long edge; means for securing said neck cut out portion around the neck;

C. a first elongated fastener secured on said first surface disposed horizontally with respect to one of said long edges and being located near a first corner formed by the intersection of said first long edge and said first short edge; and D. a second elongated fastener secured on said second surface disposed horizontally with respect to one of said long edges and being located near a second corner formed by the intersection of said second long edge and said first short edge, said second elongated fastener being detachably securable to said first elongated fastener so that a cup portion is formed by the first and second corners upon securing said elongated fasteners to each other.

2. The invention of claim 1 wherein said elongated fasteners are hook and loop fasteners.

3. The invention of claim 2 wherein said piece of material is water resistant.

4. The invention of claim 3 wherein said piece of material is washable.

5. The invention of claim 4 further comprising a means for securing said neck cut-out portion around a neck.

6. The invention of claim 5 further comprising an eyelet trim on said first and second long edges and on said firsthand second short edges.

7. A multipurpose bib comprising:

A. a piece of material being in generally rectangular form, having a first and a second long edge, a first and a second short edge, a first surface and a second surface;

B. a neck cut-out portion on said first long edge; means for securing said neck cut out portion around the neck;

C. a first elongated fastener secured on said first surface disposed horizontally with respect to one of said long edges and being located near a first corner formed by the intersection of said second long edge and said first short edge; and D. a second elongated fastener secured on said second surface disposed horizontally with respect to one of said long edges and being located near a second corner formed by the intersection of said first long edge and said first short edge, said second elongated fastener being detachably securable to said first elongated fastener so that a cup portion is formed by the first and second corners upon securing said elongated fasteners to each other.

8. The invention of claim 7 wherein said elongated fasteners are hook and loop fasteners.

9. The invention of claim 8 wherein said piece of material is water resistant.

10. The invention of claim 9 wherein said piece of material is washable.

11. The invention of claim 10 further comprising an eyelet trim on said two first and second long edges and on said first and second short edges.

* * * * *